US005274400A

United States Patent [19]

Johnson et al.

[11] Patent Number: 5,274,400

[45] Date of Patent: Dec. 28, 1993

[54] INK PATH GEOMETRY FOR HIGH TEMPERATURE OPERATION OF INK-JET PRINTHEADS

[75] Inventors: David A. Johnson, Fallbrook; Scott W. Hock, San Diego, both of Calif.

[73] Assignee: Hewlett-Packard Company, Palo Alto, Calif.

[21] Appl. No.: 874,926

[22] Filed: Apr. 28, 1992

[51] Int. Cl.[5] ..... B41J 2/21; B41J 2/05

[52] U.S. Cl. ..... 346/140 R; 106/20 D

[58] Field of Search ..... 346/140; 106/20 D

[56] References Cited

U.S. PATENT DOCUMENTS

| | | | |
|---|---|---|---|
| 4,380,771 | 4/1983 | Takatori | 346/140 R |
| 4,505,749 | 3/1985 | Kanekiyo | 106/20 |
| 4,683,481 | 7/1987 | Johnson | 346/140 R |
| 4,882,595 | 11/1989 | Trueba | 346/140 R |
| 4,914,562 | 4/1990 | Abe | 346/140 R |
| 5,026,426 | 6/1991 | Russell | 106/22 |
| 5,108,504 | 4/1992 | Johnson | 106/25 |

*Primary Examiner*—Joseph W. Hartary

[57] ABSTRACT

The effects of heating on a printhead (16) used in a thermal ink-jet printer (10) provided with a heating means (30) to assist in drying ink on a print medium (12) are compensated for by making adjustments in the geometry, or architecture, of the printhead. Specifically, the dimensions of two portions of the structure for a cyan printhead are adjusted to provide more fluidic drag, first, by increasing the channel damping, and second, by increasing the shelf damping. The channel damping is increased by altering the dimensions of the ink-feed channel (48) leading towards the nozzle (42)/resistor (44) area, or firing chamber (50), specifically, by both lengthening and narrowing the ink feed channel. The shelf damping is increased by increasing that portion (52) between the edge (54*a*) of the ink refill slot (54) and the entrance to the ink feed channel. This increase in shelf length is most easily achieved by decreasing the width of the associated ink refill slot.

11 Claims, 4 Drawing Sheets

FIG. 1
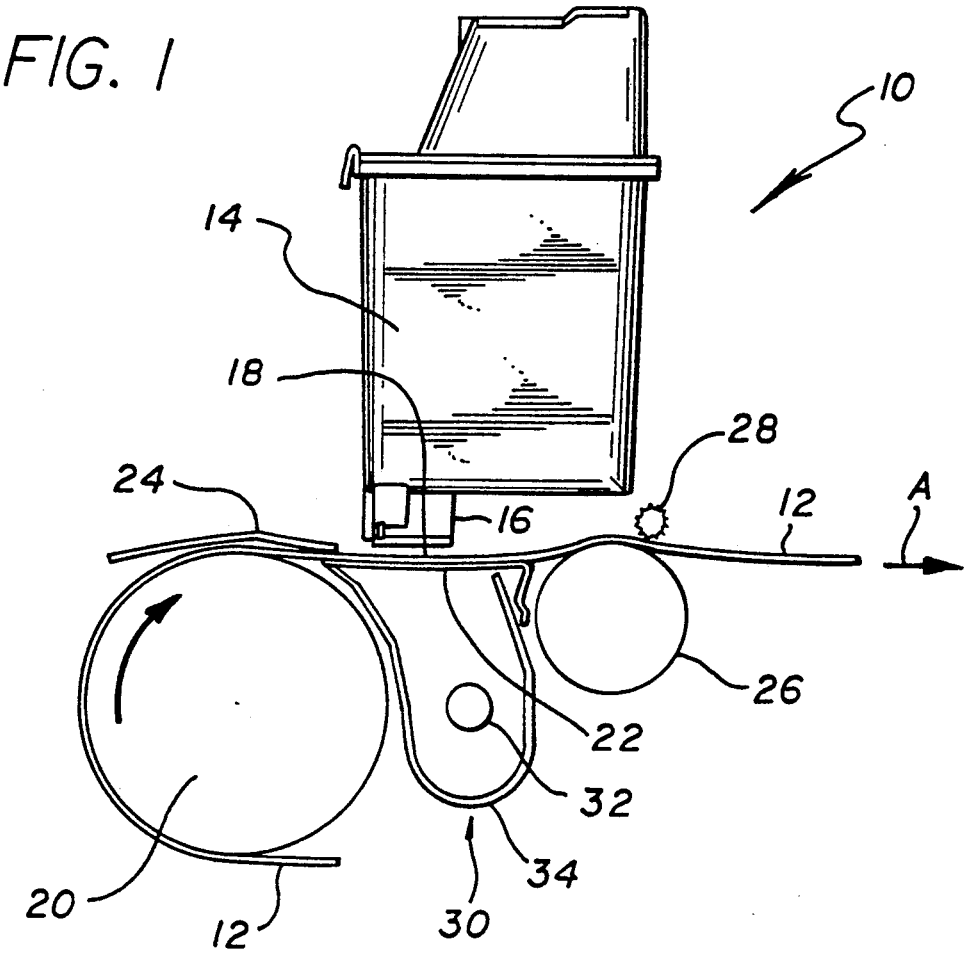
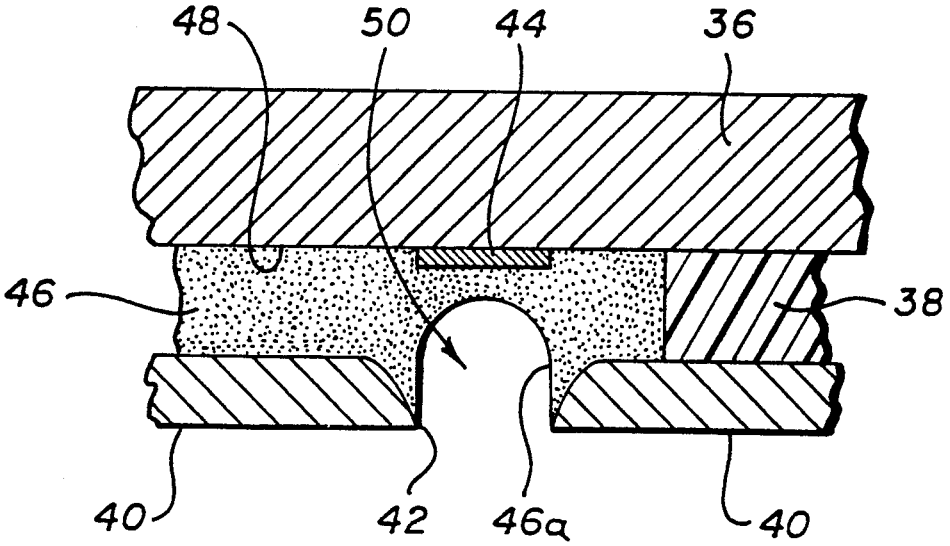
FIG. 2

INK PATH GEOMETRY FOR HIGH TEMPERATURE OPERATION OF INK-JET PRINTHEADS

TECHNICAL FIELD

The present invention relates generally to thermal ink-jet printers, and, more particularly, to thermal ink-jet printers employing a heating means to aid in drying ink on the print medium.

BACKGROUND ART

Thermal ink-jet printers which use heaters to dry ink on print media can also cause the print cartridge to be warmed significantly, since the heater is generally near the region of printing. This additional warming of the print cartridge causes unique problems in the operation of the printhead. Though the invention described herein was necessary only for one of the four inks used in a commercial color thermal ink-jet printer employing such a heater, it is generally applicable as a means of overcoming problems of high temperature operation on any ink-jet system suffering from the problems described.

There is a supply channel leading from the ink reservoir to each nozzle in an orifice plate. This supply channel, or ink feed channel, is carefully designed to provide a certain amount of resistance to flow. The optimal fluidic resistance balances the need for quick refill against the need for well-behaved (well-damped) refill dynamics. The fluidic resistance is necessary to provide sufficient damping of the ink in the nozzle during the refill portion of a drop ejection cycle. When a print cartridge is heated as described above, the ink in the printhead becomes less viscous. As a consequence, the fluidic damping is reduced, which decreases the stability of the ink refill process. In addition, the surface tension of the ink decreases as a function of temperature. These effects combine to cause the refilling ink meniscus to spill out onto the surface of the orifice plate, through which the ink is ejected from the printhead, and thereby form puddles. These puddles around the ink nozzles interfere with subsequent drop ejections.

Another consideration is that the warmer the printhead, the larger the drop that is ejected. When larger drops are ejected, the ink refill process starts with the ink meniscus in a more deeply retracted position. The combinations of unstable ink refill, low viscosity, and a deeply retracted meniscus makes the refill process susceptible to air ingestion. Ingested air bubbles interfere with subsequent drop ejection cycles, causing the next drop (or drops) to be either weak or missing.

Thus, what is required is a reconfigured printhead architecture that takes into account the foregoing considerations for thermal ink-jet printers employing a heating means to assist in drying ink printed onto a print medium.

DISCLOSURE OF INVENTION

In accordance with the invention, the effects of heating on a printhead in a thermal ink-jet printer are compensated for by making adjustments to the geometry, or architecture, of the printhead. Specifically, the dimensions of two portions of the structure are adjusted to provide more fluidic drag:

(1) Increased channel damping:

A portion of the damping is provided by the dimensions of the ink feed channel leading towards the nozzle/resistor area. The dimensions of this channel are altered in accordance with the invention to provide a net increase in drag.

(2) Increase in "shelf" damping:

Additional fluidic damping is provided by the "shelf" region, that portion between the edge of the ink refill slot and the entrance to the ink feed channel. Increasing the length of the shelf increases the damping. This shelf length increase is most easily achieved by decreasing the width of the ink refill slot.

The additional damping introduced by these geometrical changes will alter the refill dynamics of the nozzle. Indeed, the increased damping actually increases the theoretical frequency response of the nozzle, since the ink meniscus starts at a less retracted position.

BRIEF DESCRIPTION OF THE DRAWINGS

FIG. 1 is a schematic drawing of a portion of a thermal ink-jet printer, employing heating means, depicting the relation of the print cartridge with its printhead to the print medium and heating means;

FIG. 2 is a cross-sectional view of a portion of the printhead, showing deep retraction of the ink meniscus during refill;

BEST MODES FOR CARRYING OUT THE INVENTION

Figure 3:
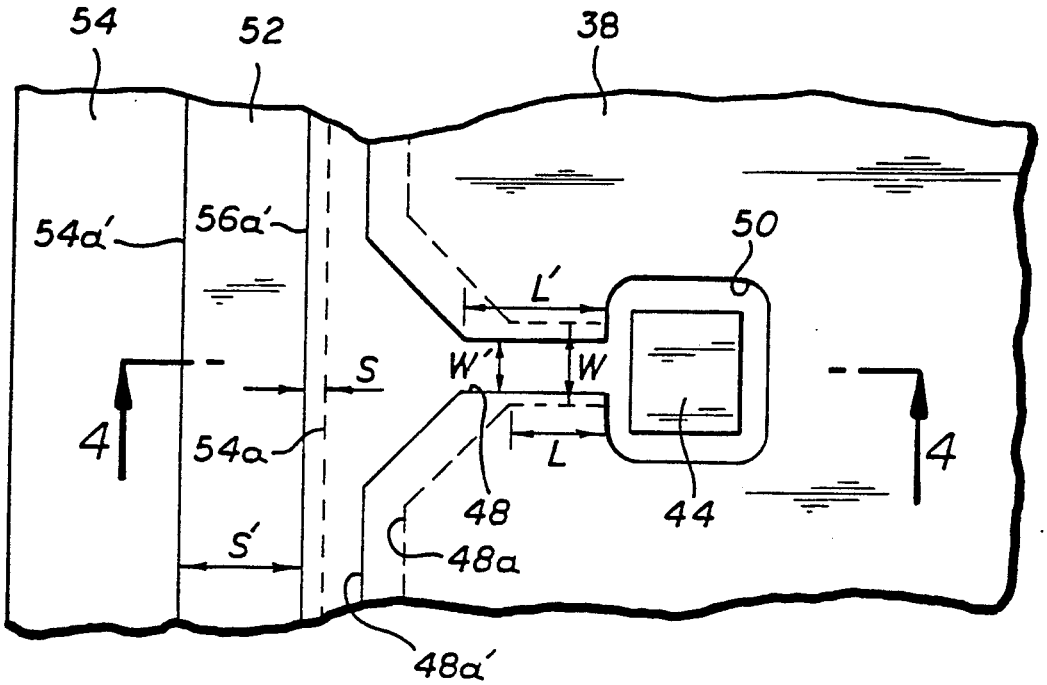
FIG. 3 is a top plan view of a portion of a printhead, comparing the prior art barrier and shelf dimensions with those in accordance with the invention.

FIG. 1 depicts an ink-jet printer 10, showing a portion thereof only, comprising a print medium 12 moved past a print cartridge, or pen, 14 having affixed thereto a printhead 16 in operative association with the print medium. The printhead 16 establishes a print zone 18. As is customary, the print medium 12 is moved along a paper path in the printer, in the direction denoted by the arrow A, and the print cartridge 14 is moved orthogonal thereto. The print medium 12 is moved by a drive roller 20 onto a screen 22. A drive plate 24, positioned after the drive roller 20 and prior to the print cartridge 14 aids in holding print medium 12 flat on the screen 22. The screen 22, which acts like a platen, is perforated so as to permit the drying of the print medium, as described more fully below. The print medium 12 exits the print zone 18 by means of an exit roller 26 and a plurality of starwheels 28 to be collected in a paper collection means, such as a tray (not shown).

A recent modification in thermal ink-jet printers involves the use of a heating means, generally depicted at 30, which is positioned close to the print zone 18. In FIG. 1, the heating means 30 is depicted as comprising a print heater 32 and a reflector 34, which serves to concentrate the heat on the bottom of the print medium 12, through the screen 22. However, it will be readily apparent to those skilled in the art that the heating means 30 may comprise any of the usual heat sources, such as heating elements, blowers, and the like, and the invention is not so limited as to the heating source. Nor is the invention limited to the placement of the heating source, which may be ahead of the print zone 18, behind the print zone, or in the print zone or which may be located beneath the print medium 12, as shown, or above it.

FIG. 2 depicts in cross-section a portion of the printhead 16, comprising a substrate 36, a barrier layer 38, and an orifice plate, or member, 40 with an opening, or nozzle, 42 therein. The nozzle 42 is positioned above a thermal element 44, commonly a resistor element, or heater-resistor. In practice, the orifice plate 40 has a plurality of nozzles 42 in it, each one operatively associated with a resistor 44, as is well-known. The present invention is not limited to the particular orifice member 40 employed, which may be separate or integral with the barrier layer 38. Indeed, any orifice member overlying the thermal element 44 may be employed in the practice of the invention.

In operation, ink 46 fills the ink feed channel 48; each resistor is fed by such a channel, which is defined by the substrate 36, the barrier layer 38, and the orifice plate 40 Each resistor 44 is connected by an electrically conductive trace (not shown) to a current source, which, under control of a computer (not shown), sends current pulses to selected resistors 44, causing a droplet of ink to be expelled through the nozzle 42 and onto the print medium 12 in a desired pattern of alphanumeric characters, area fill, and other print patterns. The details of such thermal ink-jet printers are described, for example, in the *Hewlett-Packard Journal*, Vol. 36, No. 5, May 1985, and do not form a part of this invention.

FIG. 2 depicts the meniscus 46a of ink 46 more deeply retracted than usual, following a drop ejection, as a result of heating of the printhead from the heating source 30. Such deep retraction can result in the ingestion of air into the firing chamber 50 (that portion of the printhead lying generally between the resistor 44 and the nozzle 42), the consequence of which is interference with subsequent drop ejection cycles, as described earlier.

FIG. 3, which is a top plan view of a portion of the printhead, provides a comparison of the old configuration, previously employed in thermal ink-jet printers not employing a heating source 30, and of the configuration of the invention, employing such a heating source. For ease in viewing, the nozzle plate 40 is removed. The old configuration is depicted in dashed lines, while the new configuration is depicted in solid lines.

Increased channel damping is provided in accordance with the invention by altering the dimensions of the ink feed channel 48 leading towards the nozzle/resistor area (the firing chamber 50). Specifically, the cross-sectional area of the ink feed channel 48 is reduced, preferably by simply reducing the width W of the channel to width W'. In addition, the length L of the channel is increased to L'.

The effect of shelf length on the overall quality of performance is demonstrated in FIG. 5, discussed in greater detail below. All data on this plot refer to designs where the barrier was held constant at the narrower/longer dimension, all other parameters were also held constant except for the shelf length. The damping plot (FIG. 6, also discussed in greater detail below) shows the combined effect of both shelf length and barrier dimensions.

Figure 4:
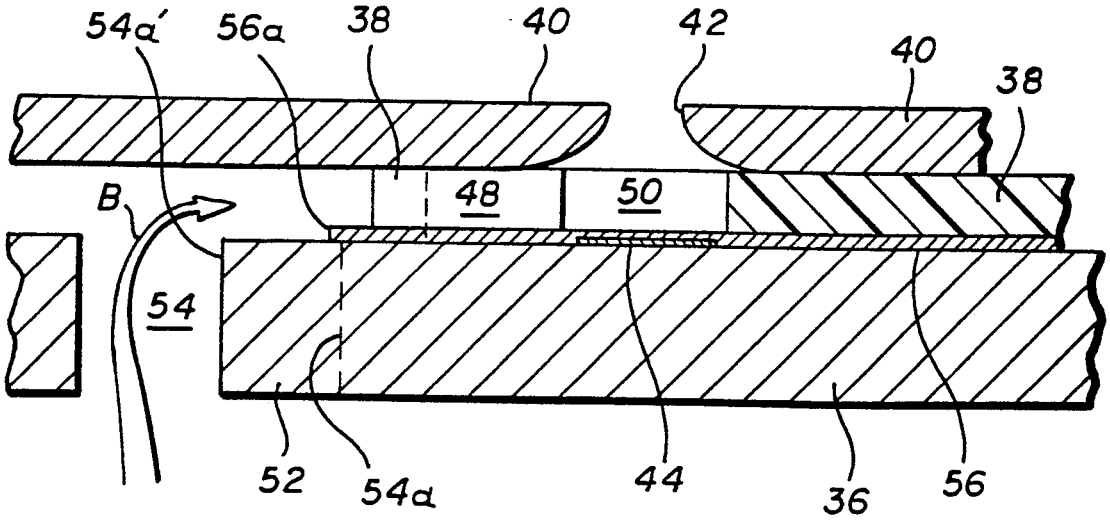
FIG. 4 is a cross-sectional view taken along the lines 4—4 of FIG. 3.

While a portion of the damping is provided by the dimensions of the channel leading toward the firing chamber 50, additional fluidic damping is providing by altering the dimensions of the "shelf" region 52, as shown in both FIGS. 3 and 4. The shelf region 52 is that portion between the edge 54a of the ink refill slot 54 and the entrance to the ink feed channel 48. Increasing the shelf length S to S' increases the damping. This shelf length increase is most easily achieved by decreasing the width of the associated ink refill slot 54.

FIG. 4 depicts the ink flow path, shown by arrow B, up through the ink refill slot 54, into the ink feed channel 48, and into the firing chamber 50. A passivation layer 56 lies over the substrate 36 and the resistor 44. This passivation layer typically comprises a silicon nitride-silicon carbide material, as is well-known. Additionally, there are several other layers in the thin film construction of an ink-jet printhead; these are omitted from the drawing for clarity.

The barrier extension, L'—L, and the shelf extension, S'—S, are both depicted in FIG. 4.

In the prior art configuration, the edge 54a of the shelf 54 is actually cut back underneath the passivation layer 56 to a certain extent. The maximum allowable in these structures is about −23 μm. However, the shelf edge 54a nonetheless is still maintained some distance from the outer extension 48a of the ink feed channel 48.

In the configuration of the invention, the edge 54a' of the shelf 54 is moved considerably away from the outer extension 48a' of the ink feed channel 48. As noted above, movement of the shelf 52 is best accomplished by narrowing the width of the ink refill slot 54.

Figure 5:
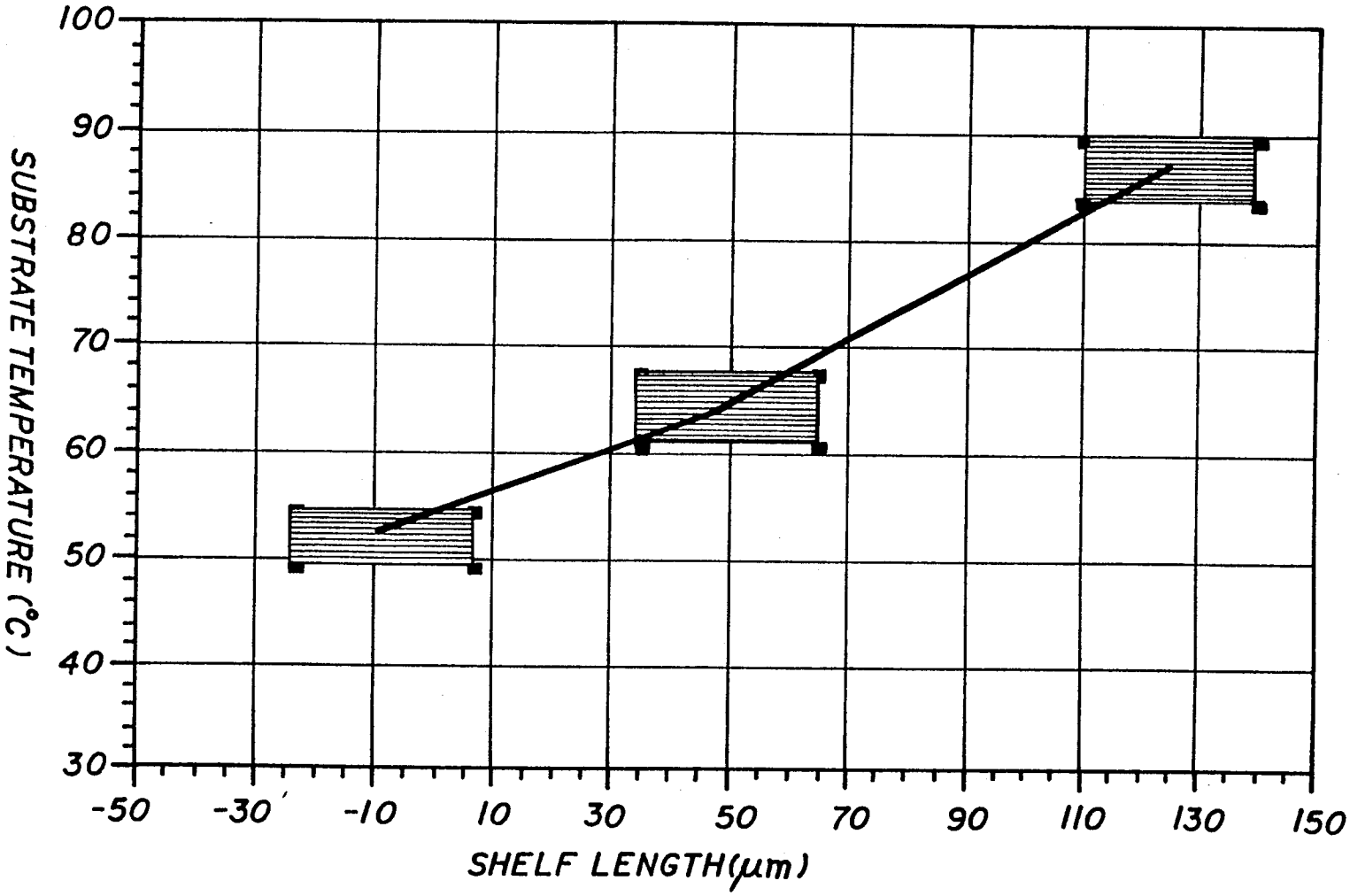
FIG. 5, on coordinates of substrate temperature (°C.) and shelf length, is a plot relating temperature to print quality.

FIG. 5 is a plot of the range in which good print quality is obtained, relating substrate temperature and shelf length. The shelf length in FIG. 5 is measured relative to the edge 56a of the passivation layer 56. However, it will be appreciated that the actual length that governs this damping relationship is the distance from the resistor 44 to the ink refill slot 54. The prior art printhead, operating at room temperature, is seen to have a negative shelf length relative to the passivation edge, as described above.

The shelf length preferably ranges from about 30 μm to 150 μm. At a value less than about 30 μm, the temperature that the printhead 16 experiences from the heater means 30 would exceed the maximum allowable temperature for acceptable print quality. At a value greater than about 150 μm, there is no further benefit, because the boiling point of the ink becomes the upper limit of operation.

In the color thermal inkjet printer with modified printhead as described above, the following ink formulations are preferably employed:

Cyan:
- about 5 to 15 wt %, and preferably about 7.9 wt %, diethylene glycol,
- about 0.5 to 5.0 wt %, and preferably about 1.1 wt %, Acid Blue A, dye (sodium cations),
- about 0.1 to 1.0 wt % bactericide, and preferably about 0.3 wt % NUOCEPT biocide (NUOCEPT is a tradename of Hüls America, Piscataway, N.J.),
- balance water;

Yellow:
- about 5 to 15 wt %, and preferably about 5.4 wt %, diethylene glycol, about 0.5 to 5.0 wt %, and preferably about 1.25 wt %, Acid Yellow 23 dye (tetramethylammonium cations), about 0.1 to 1.0 wt % bactericide, and preferably about 0.3 wt % NUOCEPT biocide, about 0.08 wt % buffer, preferably potassium phosphate, balance water;

Magenta:

about 5 to 15 wt %, and preferably about 7.9 wt %, diethylene glycol, about 0.5 to 5.0 wt %, and preferably about 2.5 wt %, Direct Red 227 dye (tetramethylammonium cations), about 0.1 to 1.0 wt % bactericide, and preferably about 0.3 wt % NUOCEPT biocide, balance water; and Black:

about 5 to 15 wt %, and preferably about 5.5 wt %, diethylene glycol, about 0.5 to 5.0 wt %, and preferably about 2.5 wt %, Food Black 2 dye (lithium cations), about 0.05 to 1.0 wt % bactericide, and preferably about 0.08 wt % PROXEL biocide (PROXEL is a tradename of ICI America), about 0.2 wt % buffer, preferably sodium borate, balance water.

It is with respect to the cyan ink that the above-noted changes in the printhead geometry are made. This is due to the greater effect of heat on the cyan ink than on the yellow, magenta, and black inks. However, if other ink formulations exhibit the same problems exhibited by the cyan ink noted herein, then the same changes in printhead geometry may be employed to overcome such problems.

The ink 46 that enters the ink refill slot 54 is provided from a reservoir (not shown) either contained within the body of the print cartridge 14 or external thereto. In a color printer, one or more print cartridges, each cartridge associated with one or more ink reservoirs, may be As an added benefit, modifying the geometry of the cyan printhead also reduces puddling around the nozzle 42. In the prior art geometry, puddling of ink around the nozzle 42 occurs. There are two consequences of this puddling. In the first consequence, the ink dries out as a result of the effect of the nearby heater means 30, and the dried ink is retrieved back into the nozzle 28 during the retraction phase of ink refill. The ink in the firing chamber 50 is now rich with diethylene glycol and dye, and when ejected, the droplets of ink have excessive dye loading, thereby producing unacceptably dark images on the print medium 12 for the first several droplets of ink until the ink is purged with fresh ink.

In the second consequence of puddling, puddles of ink near the orifice 42 can also misdirect subsequent droplets of ink, resulting in the misplaced dots of ink on the print medium 12, which adversely affect the printed image. For example, in area-fill printing, bands of light area are observed. The puddles of ink around the orifice 42 can even be sufficient enough to block the nozzle completely.

The new geometry of the invention reduces the puddling of ink to such an extent that both problems are substantially eliminated.

Figure 6:
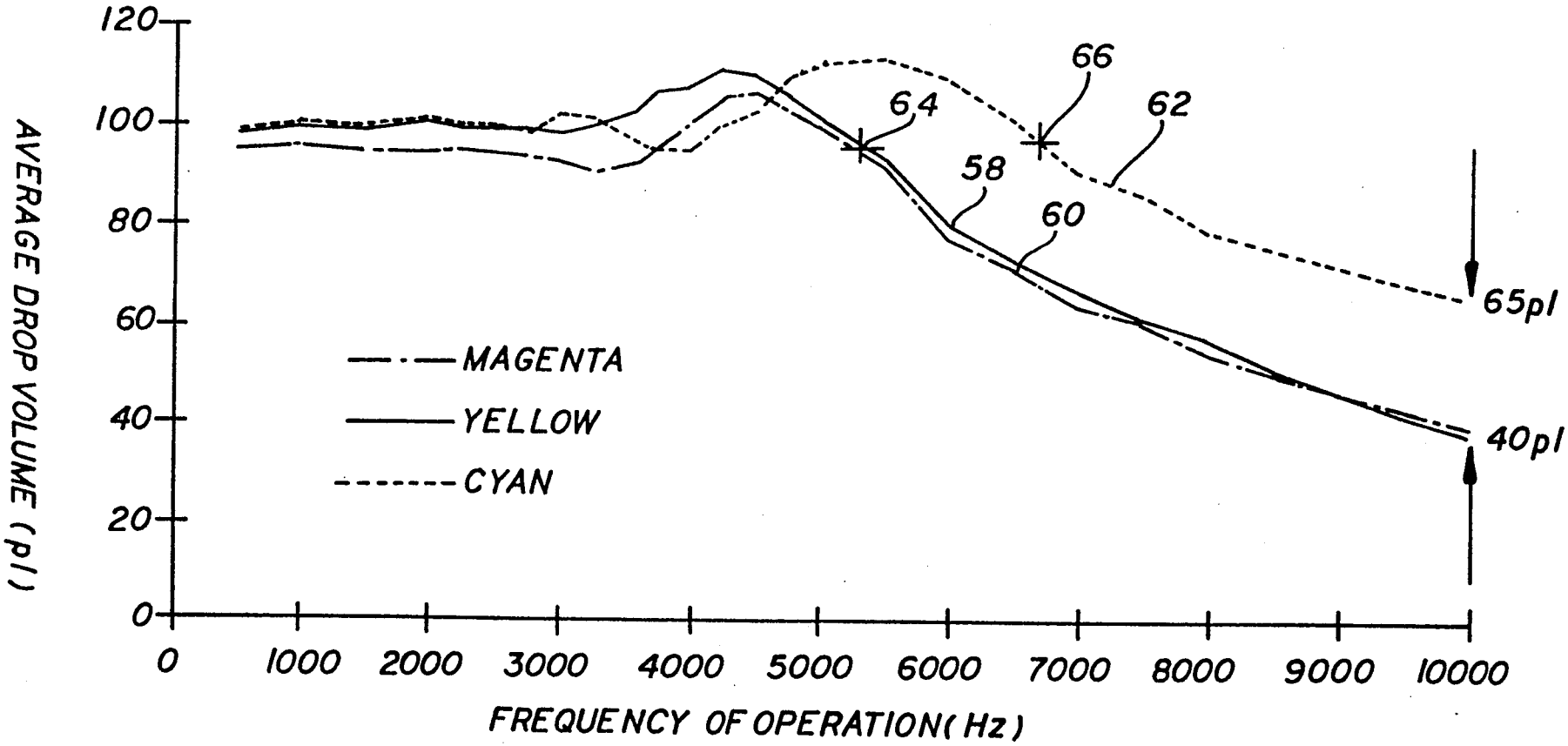
FIG. 6, on coordinates of average drop volume (in picoliters) and frequency of operation (in Hertz), show plots of the volume frequency response of the three architectures, using cyan, yellow, and magenta inks.

FIG. 6 depicts the volume frequency response of the architectures employed herein, with the yellow and magenta inks fired from pens in which the printhead utilizes the prior art architecture (Curves 58 and 60, respectively) and with the cyan ink fired from a pen in which the printhead utilizes the architecture in accordance with the invention (Curve 62).

It will be noted that in these damping plots, the cyan ink has significantly larger drop volumes at the high end of the frequencies. The reason that the drop volumes are larger in cyan than in the other inks at a given frequency is that there is more ink in the nozzle in cyan than in the other two. The reason there is more ink is because less ink was pushed down the channel 48 during the preceding drop ejection. Less ink was pushed down the channel because of the increased fluidic resistance in the cyan architecture, provided in accordance with the invention. This indicates that the cyan ink meniscus is never as deeply retracted as the yellow and magenta menisci. As a result, the drop volumes of cyan are higher at the high frequencies, and the refill time is actually shorter, since the meniscus has a shorter distance to travel, an unexpected bonus benefit. (The refill frequency as used herein is defined as the highest frequency at which the drop volume is equal to very low frequency drop volume; see point 64 for magenta and yellow and point 66 for cyan in FIG. 6.) Since the meniscus is distorted less in the cyan architecture, it can be considered to be "better behaved".

A damping "figure of merit" appropriate for describing the highly non-linear situation of ink refill is the ratio of drop volume at a high operational frequency, normalized by the drop volume at steady state (very low frequency). For this comparison, 10,000 Hz is chosen for the high frequency, and the flat portion of the curve (2,000 Hz and lower) is chosen as the low frequency. As demonstrated in FIG. 6, this value is (65 pl)/(100 pl) for the cyan print cartridge and (45 pl)/(95 pl) for the yellow print cartridge. (The magenta print cartridge is seen to have a "figure of merit" similar to that of the yellow print cartridge).

For structures delivering similar drop volumes at low frequencies, these values can be compared to each other to estimate relative damping performance. This comparison is valid for the two structures (cyan versus yellow or magenta) described herein. A larger value indicates more damping. Comparing the values shows that the cyan "figure of merit" is 37% larger than that of the yellow (or magenta) pen. This increase in damping is due to the combination of the larger shelf and the more restricted ink feed channel of the cyan structure.

In the case of the printer described herein, the printhead temperature is considerably higher than printheads in the past due to the presence of the heater. However, in the future, as printhead nozzle spacing becomes denser, operating frequencies are higher, to make higher resolution images faster, the residual heat from drop ejections alone will be sufficient to cause elevated printhead temperatures. In such cases, the architecture described herein is also applicable.

INDUSTRIAL APPLICABILITY

The modified printhead geometry for cyan ink having the composition noted above is expected to find commercial use in thermal ink-jet printers employing a heater means to assist in drying ink printed onto a print medium.

Thus, there has been disclosed a modification in the geometry of printheads, particularly a printhead associated with a cyan ink of a particular composition range, which provides improved damping and reduced puddling in inks employed in thermal ink-jet printers employing a heater means to assist in drying ink printed onto a print medium. It will be readily apparent to those of ordinary skill in the art that various changes and modifications of an obvious nature may be made without departing from the spirit of the invention, and all such changes and modifications are considered to fall within the scope of the invention as defined by the appended claims.

What is claimed is:

1. In a color thermal ink-jet printer including a heater means to provide a heated printing environment through which a print medium is passed, said color thermal ink-jet printer adapted to print colors and black inks from a group of ink reservoirs, one each containing different color and black inks, with at least one reservoir associated with a print cartridge and with at least one print cartridge associated with said ink-jet printer, said at least one print cartridge provided with a printhead, each printhead including a plurality of heater-resistors, each in a separate firing chamber supplied with ink from said ink reservoir through an ink refill slot fluidically communicating with said firing chamber by means of an ink feed channel, said printhead further including a nozzle member comprising a plurality of nozzles, each nozzle associated with a heater-resistor, through which droplets of ink are expelled toward said print medium, wherein at least one of said ink feed channel and said ink refill slot are modified in a printhead associated with a particular color relative to those of the other colors so as to provide increased fluidic damping in said printhead so modified.

2. The printer of claim 1 wherein said color inks comprise cyan, yellow, and magenta colors.

3. The printer of claim 2 wherein said color inks are given by the formulation

Cyan:
- about 5 to 15 wt % diethylene glycol,
- about 0.5 to 5.0 wt % Acid Blue 9 dye (sodium cations),
- about 0.1 to 1.0 wt % bactericide,
- balance water;

Yellow:
- about 5 to 15 wt % diethylene glycol,
- about 0.5 to 5.0 wt % Acid yellow 23 dye (tetramethylammonium cations),
- about 0.1 to 1.0 wt % bactericide,
- about 0.08 wt % buffer,
- balance water;

Magenta:
- about 5 to 15 wt % diethylene glycol,
- about 0.5 to 5.0 wt % Direct Red 227 dye (tetramethylammonium cations),
- about 0.1 to 1.0 wt % bactericide,
- balance water; and Black:
- about 5 to 15 wt % diethylene glycol,
- about 0.5 to 5.0 wt % Food Black 2 dye (lithium cations),
- about 0.05 to 1.0 wt % bactericide,
- about 0.2 wt % buffer,
- balance water.

4. The printer of claim 3 wherein said color inks are given by the formulation

Cyan:
- about 7.9 wt % diethylene glycol,
- about 1.1 wt % Acid Blue 9 dye (sodium cations),
- about 0.3 wt % biocide,
- balance water;

Yellow:
- about 5.4 wt % diethylene glycol,
- about 1.25 wt % Acid Yellow 23 dye (tetramethylammonium cations),
- about 0.3 wt % biocide,
- about 0.08 wt % potassium phosphate buffer,
- balance water;

Magenta:
- about 7.9 wt % diethylene glycol,
- about 2.5 wt % Direct Red 227 dye (tetramethylammonium cations),
- about 0.3 wt % biocide,
- balance water; and Black:
- about 5.5 wt % diethylene glycol,
- about 2.5 wt % Food Black 2 dye (lithium cations),
- about 0.08 wt % biocide,
- about 0.2 wt % sodium borate buffer,
- balance water.

5. The printer of claim 2 wherein said fluidic damping of said cyan printhead is increased.

6. The printer of claim 1 wherein said fluidic damping is increased by increasing the length of said ink feed channel and by decreasing the width of said ink feed channel.

7. The printer of claim 1 wherein said fluidic damping is increased b decreasing the width of said ink refill slot so as to thereby increase the shelf length between the edge of said ink feed slot and the entrance of said ink feed channel.

8. The printer of claim 7 wherein said shelf length ranges from about 30 to 150 μm, relative to a reference point defined by the edge of a passivation layer associated with said heater resistor.

9. In a color thermal ink-jet printer including a heater means to provide a heated printing environment through which a print medium is passed, said color thermal ink-jet printer adapted to print colors and black inks from a group of ink reservoirs, one each containing cyan, yellow, and magenta color and black inks, with at least one reservoir associated with a print cartridge and with at lest one print cartridge associated with said ink-jet printer, said at least one print cartridge provided with a printhead, each printhead including a plurality of heater-resistors, each in a separate firing chamber supplied with ink from said ink reservoir through an ink refill slot fluidically communicating with said firing chamber by means of an ink feed channel, said printhead further including a nozzle member comprising a plurality of nozzles, each nozzle associated with a heater-resistor, through which droplets of ink are expelled toward said print medium, wherein said ink feed channel is increased and said ink refill slot is decreased in the printhead firing cyan ink relative to those of the other printheads so as to provide increased fluidic damping in said printhead so modified.

10. In a color thermal ink-jet printer including a heater means to provide a heated printing environment through which a print medium is passed, said color thermal ink-jet printer adapted to print colors and black inks from a group of ink reservoirs, one each containing cyan, yellow, and magenta color and black inks, with at least one reservoir associated with a print cartridge and with at least one print cartridge associated with said ink-jet printer, said at least one print cartridge provided with a printhead, each printhead including a plurality of heater-resistors, each in a separate firing chamber supplied with ink from said ink reservoir through an ink refill slot fluidically communicating with said firing chamber by means of an ink feed channel, said printhead further including a nozzle member comprising a plurality of nozzles, each nozzle associated with a heater-resistor, through which droplets of ink are expelled toward said print medium, wherein the width of said ink refill slot is decreased in the printhead firing cyan ink relative to that of the other printheads so as to thereby increase the shelf length between the edge of said ink feed slot and the entrance of said ink feed channel and thus provide increased fluidic damping in said printhead so modified.

11. The printer of claim 10 wherein said shelf length ranges from about 30 to 150 μm, relative to a reference point defined by the edge of a passivation layer associated with said heater resistor.

* * * * *